US008436219B2

(12) United States Patent
Talley et al.

(10) Patent No.: US 8,436,219 B2
(45) Date of Patent: May 7, 2013

(54) METHOD OF GENERATING A NON-PLUGGING HYDRATE SLURRY

(75) Inventors: Larry D. Talley, Friendswood, TX (US); Douglas J. Turner, Humble, TX (US); Douglas K. Priedeman, Doha (QA)

(73) Assignee: ExxonMobil Upstream Research Company, Houston, TX (US)

( * ) Notice: Subject to any disclaimer, the term of this patent is extended or adjusted under 35 U.S.C. 154(b) by 694 days.

(21) Appl. No.: 12/162,477

(22) PCT Filed: Feb. 22, 2007

(86) PCT No.: PCT/US2007/004736

§ 371 (c)(1), (2), (4) Date: Jul. 28, 2008

(87) PCT Pub. No.: WO2007/095399

PCT Pub. Date: Aug. 23, 2007

(65) Prior Publication Data

US 2009/0078406 A1 Mar. 26, 2009

Related U.S. Application Data

(60) Provisional application No. 60/782,449, filed on Mar. 15, 2006, provisional application No. 60/899,000, filed on Feb. 2, 2007.

(51) Int. Cl.
*F17D 1/08* (2006.01)

(52) U.S. Cl.
USPC ..... 585/15; 208/370; 585/899; 137/2; 137/13; 137/803; 166/302

(58) Field of Classification Search ..... 585/15
See application file for complete search history.

(56) References Cited

U.S. PATENT DOCUMENTS 3,372,753 A 3/1968 Tuttle
3,514,274 A 5/1970 Cahn et al.

(Continued)

FOREIGN PATENT DOCUMENTS

CA 2036084 8/1991
CN 1429896 7/2003

(Continued)

OTHER PUBLICATIONS

Erik M. Freer et al., "Methane hydrate film growth kinetics", Fluid Phase Equilibria, 2001, pp. 65-75, vol. 185, Elsevier Science B.V.

(Continued)

*Primary Examiner* — Ellen McAvoy
(74) *Attorney, Agent, or Firm* — ExxonMobil Upstream Research Company Law Dept.

(57) ABSTRACT

Method for reducing loss of flow due to hydrate solids deposits and wax deposition in a pipeline without the aid of chemicals and system for transporting a flow of wellstream hydrocarbons containing water, using a main pipeline and a cold-flow reactor connected to the main pipeline or within or forming a part of the pipeline, wherein at least a portion of the wellstream is fed to the cold-flow reactor. Also provided is a method for preventing hydrate nucleation and growth in a pipeline and preventing hydrate agglomeration as well as for preventing wax deposition. The provided method eliminates the use of energized equipment for melting, grinding or scraping hydrate solids from inside of pipelines or flowlines. Generating dry hydrates to be mixed with main flow of a wellstream is also described.

43 Claims, 7 Drawing Sheets

U.S. PATENT DOCUMENTS 4,267,043 A 5/1981 Benson
4,328,098 A 5/1982 Benson
4,589,434 A 5/1986 Kelley
4,687,585 A 8/1987 Ramshaw
4,697,426 A 10/1987 Knowles, Jr.
4,883,582 A * 11/1989 McCants ..... 208/106
4,915,176 A 4/1990 Sugier et al. ..... 166/371
4,973,775 A 11/1990 Sugier et al. ..... 585/15
5,055,178 A 10/1991 Sugier et al.
5,178,641 A * 1/1993 Konrad et al. ..... 44/392
5,244,878 A 9/1993 Sugier et al. ..... 507/90
5,283,001 A 2/1994 Gregoli et al.
5,284,581 A 2/1994 Benson
5,286,376 A 2/1994 Benson
5,426,258 A 6/1995 Thomas et al. ..... 585/15
5,427,680 A 6/1995 Benson
5,434,323 A 7/1995 Durand et al. ..... 585/15
5,491,269 A 2/1996 Colle et al. ..... 585/15
5,536,893 A 7/1996 Gudmundsson
5,600,044 A 2/1997 Colle et al.
5,676,848 A 10/1997 Benson
5,744,665 A 4/1998 Costello et al.
5,816,280 A 10/1998 Rojey et al.
5,817,898 A 10/1998 Delion et al. ..... 585/15
5,841,010 A 11/1998 Rabeony et al.
5,863,301 A * 1/1999 Grosso et al. ..... 44/301
5,874,660 A 2/1999 Colle et al. ..... 585/15
5,877,361 A 3/1999 Rojey et al.
5,879,561 A 3/1999 Klomp et al. ..... 210/698
5,888,407 A 3/1999 Benson
5,893,642 A 4/1999 Hewitt et al.
5,900,516 A 5/1999 Talley et al.
5,936,040 A 8/1999 Costello et al.
5,941,096 A 8/1999 Gudmundsson
5,954,950 A * 9/1999 Morel et al. ..... 208/213
5,958,844 A 9/1999 Sinquin et al. ..... 507/90
6,015,929 A 1/2000 Rabeony et al.
6,028,233 A 2/2000 Colle et al.
6,028,234 A 2/2000 Heinemann et al.
6,080,704 A 6/2000 Halliday et al.
6,082,118 A 7/2000 Endrizzi et al.
6,102,986 A 8/2000 Klug ..... 95/153
6,107,531 A 8/2000 Colle et al.
6,177,497 B1 1/2001 Klug et al. ..... 524/376
6,180,843 B1 1/2001 Heinemann et al.
6,194,622 B1 2/2001 Peiffer et al.
6,281,274 B1 8/2001 Bakeev et al.
6,307,191 B1 10/2001 Waycuilis
6,331,508 B1 12/2001 Pakulski
6,350,928 B1 2/2002 Waycuilis et al.
6,359,047 B1 3/2002 Thieu et al. ..... 524/376
6,369,121 B1 4/2002 Catalfamo et al.
6,412,135 B1 7/2002 Benson
6,444,852 B1 9/2002 Milburn et al. ..... 564/292
6,451,892 B1 9/2002 Bakeev et al.
6,550,960 B2 * 4/2003 Catalfamo et al. ..... 366/337
6,566,309 B1 5/2003 Klug et al. ..... 507/90
6,656,366 B1 12/2003 Fung et al.
6,672,391 B2 1/2004 Anderson et al. ..... 166/357
6,703,534 B2 3/2004 Waycuilis et al.
6,756,021 B2 6/2004 Botrel
6,774,276 B1 8/2004 Lund et al.
6,867,262 B1 3/2005 Angel et al.
6,957,146 B1 10/2005 Taner et al. ..... 702/14
6,988,550 B2 * 1/2006 Bragg et al. ..... 166/275
7,008,466 B2 3/2006 Collins
7,121,339 B2 * 10/2006 Bragg et al. ..... 166/275
7,183,240 B2 2/2007 Dahlmann et al. ..... 507/240
7,225,078 B2 5/2007 Shelley et al. ..... 702/13
7,253,138 B2 8/2007 Dahlmann et al. ..... 508/243
7,261,810 B2 * 8/2007 Argo et al. ..... 208/370
7,264,653 B2 9/2007 Panchalingam et al. ..... 95/153
7,281,844 B2 10/2007 Glanville ..... 366/340
7,397,976 B2 7/2008 Mendez et al. ..... 385/12
7,511,180 B2 * 3/2009 Waycuilis ..... 585/15
7,541,009 B2 6/2009 Takao et al. ..... 422/198
7,611,683 B2 11/2009 Grund et al. ..... 422/211
7,615,516 B2 11/2009 Yang et al. ..... 507/90
7,856,848 B2 12/2010 Lu ..... 62/623
7,947,857 B2 5/2011 Nazari et al. ..... 585/15
7,958,939 B2 * 6/2011 Talley ..... 166/369
7,994,374 B2 8/2011 Talley et al. ..... 585/15
8,034,748 B2 10/2011 Dahlmann et al. ..... 507/90
8,047,296 B2 11/2011 Tian et al. ..... 166/366
2004/0129609 A1 7/2004 Argo et al.
2004/0133531 A1 7/2004 Chen et al. ..... 706/8
2004/0143145 A1 7/2004 Servio et al.
2004/0176650 A1 9/2004 Lund et al.
2005/0137432 A1 6/2005 Matthews et al.
2006/0009363 A1 1/2006 Crews ..... 507/100
2006/0058449 A1 3/2006 Angel et al.
2006/0084581 A1 * 4/2006 Bragg et al. ..... 507/269
2006/0106265 A1 5/2006 Rivers et al.
2006/0175062 A1 8/2006 Benson
2006/0175063 A1 8/2006 Balkanyi et al.
2006/0186023 A1 * 8/2006 Balkanyi et al. ..... 208/263
2006/0205603 A1 9/2006 Colle et al.
2006/0254766 A1 11/2006 Richard et al.
2006/0272805 A1 12/2006 O'Malley et al.
2007/0276169 A1 11/2007 Tohidi et al. ..... 585/15
2008/0023071 A1 1/2008 Smith et al. ..... 137/13
2008/0064611 A1 3/2008 Spratt ..... 507/90
2008/0101999 A1 5/2008 Balczewski
2008/0102000 A1 5/2008 Balczewski
2008/0103343 A1 5/2008 Balczewski
2009/0124520 A1 5/2009 Tohidi ..... 507/90
2009/0235850 A1 9/2009 Caro et al. ..... 110/346
2010/0012325 A1 1/2010 Friedemann ..... 166/335
2010/0099807 A1 4/2010 Carlise et al. ..... 524/377
2010/0099814 A1 4/2010 Conrad et al. ..... 524/555
2010/0145115 A1 * 6/2010 Lund et al. ..... 585/15
2010/0180952 A1 * 7/2010 Verhelst et al. ..... 137/2
2010/0193194 A1 * 8/2010 Stoisits et al. ..... 166/335
2010/0236634 A1 * 9/2010 Nuland et al. ..... 137/13
2011/0220352 A1 * 9/2011 Lund et al. ..... 166/265
2011/0308625 A1 12/2011 Stoisits et al. ..... 137/1

FOREIGN PATENT DOCUMENTS

CN 1429896 A 5/2005
EP 0526929 1/1996
EP 0566394 6/1996
EP 1159238 8/2008
EP 1957856 3/2009
JP 2003/041271 2/2003
JP 2003/055676 2/2003
JP 2003 055676 A 2/2003
JP 2003041271 A 2/2003
JP 2004182885 A 7/2004
JP 2004197006 A 7/2004
JP 2004346184 A 12/2004
JP 2005008347 A 1/2005
WO WO93/25798 12/1993
WO WO95/17579 6/1995
WO WO96/34177 10/1996
WO WO 98/17941 A1 4/1998
WO WO99/13197 3/1999
WO WO 00/25062 A1 5/2000
WO WO 2004/063314 A1 7/2004
WO WO 2005/026291 A1 3/2005
WO WO 2005/058450 A2 6/2005
WO WO 2006/027609 A1 3/2006
WO WO 2006/048666 A2 5/2006
WO WO2006/052455 5/2006
WO WO 2006/054076 A1 5/2006
WO WO 2006/068929 A1 6/2006
WO WO2007/025062 3/2007
WO WO2007/095399 8/2007
WO WO2008/023979 2/2008
WO WO2009/008737 1/2009
WO WO2009/054733 4/2009
WO WO2010/083095 7/2010
WO WO2011/062720 5/2011
WO WO2011/062793 5/2011
WO WO2011/109118 9/2011

OTHER PUBLICATIONS

Nimalan Gnanendran et al., "Modelling hydrate formation kinetics of a hydrate promoter-water-natural gas system in a semi-batch spray reactor", Chemical Engineering Science, 2004, pp. 3849-3863, vol. 59, Elsevier Science B.V.
C. D. Grace, "Static Mixing and Heat Transfer", Chemical and Processing Engineering, 1971, pp. 57-59.
T. Johnson et al., "Looking for Hydrates in Places Other Than Flowlines and Pipelines", OTC17345, 2005 Offshore Technology Conference, May 2-5, 2005, 4 pages, Houston, TX.
R. Larsen et al., "Conversion of Water to Hydrate Particles", SPE 71550, SPE Annual Technical Conference, Sep. 30-Oct. 3, 2001, pp. 1-5, New Orleans, LA.
Ju Dong Lee et al., "Methane-ethane and methane-propane hydrate formation and decomposition on water droplets", Chemical Engineering Science, 2005, pp. 4203-4212, vol. 60, Elsevier Science B.V.
K. N. Li et al., "Experimental Research on the Influence of Jet Pump on the Cooling Storage Property of Gas Hydates", International Journal of Modern Physics B, 2005, pp. 507-509, vol. 19 Nos. 1, 2 & 3, World Scientific Publishing Company.
M. Mork et al., "Rate of Hydrate Formation in Subsea Pipelines, Correlation Based on Reactor Experiments", 12$^{th}$ International Oil Field Chemistry Symposium, Apr. 1-4, 2001, 11 pages, Geilo Norway.
Hideo Tajima et al., "Continuous Formation of Gas Hydrate by Static Mixing", Preprints—American Chemical Society, Division of Petroleum Chemistry, 2005, 2 pages, 50(1).
Hideo Tajima et al., "Continuous Formation of $Co_2$ Hydrate via a Kenics-Type Static Mixer", Energy & Fuels, 2004, pp. 1451-1456, vol. 18, American Chemical Society.
Hideo Tajima et al., "Continuous Gas Hydrate Formation Process by Static Mixing of Fluids", 5$^{th}$ International Conference on Gas Hydrates, Jun. 12-16, 2005, 6 pages, Trondheim, Norway.
Yingming Xie et al., "Gas hydrate fast nucleation from melting ice and quiescent growth along vertical heat transfer tube", Science in China, Series B, 2005, pp. 75-82, vol. 48/1.
European Search Report No. 113890, dated Sep. 5, 2006, 3 pages.
PCT International Search Report and Written Opinion, Apr. 28, 2008, 6 pages.
PCT International Preliminary Report on Patentability, Sep. 25, 2008, 5 pages.
Hemmingson, P. V. et al. (2008) "Hydrate Plugging Potential in Underinhibited Systems", Proc. of the 6th ICGH, Vancouver, Canada.
Ida, Hiroyuki et al. (2004) "Highly Efficient Natural Gas Hydrate Production Technology," Jfe Giho, v. 6 pp. 76-80 (ISSN 13480669).
Ilahi, M. (2005) "Evaluation of Cold Flow Concepts," Masters Thesis, Norwegian Univ. of Sci. And Tech., Jun. 2005, 123 pages.
Rogers, R. et al. (2006) "Gas Hydrate Storage of Natural Gas," Doe #De-FC26-01NT41297, Jul. 13, 2006, 79 pages.
Sloan, E. D. (1997) "Gas Hydrate Tutorial," Preprints-Meeting of the ACS Division of Fuel Chemistry, v. 42, No. 2, pp. 449-456 (American Chemical Society, 1997).
Talley, L. et al. (1999) "First Low Dosage Hydrate Inhibitor is Field Proven in Deepwater," Pipeline and Gas Journal, v. 44, p. 226.
Talley, L. et al. (2001) "Comparison of Laboratory Results on Hydrate Induction Rates in a THF Rig, High-Pressure Rocking Cell, Miniloop, and Large Flowloop," Gas Hydrates, Challenges for the Future: Annals of the New York Academy of Sciences, v.912, pp. 314-321.
Urdahl, O. et al. (1997) "Experimental Testing and Evaluation of a Kinetic Gas Hydrate Inhibitor in Different Fluid Systems," Preprints-Meeting of the ACS Div. of Fuel Chemistry, v. 42, pp. 498-502.
Valberg, T. (2006) "Efficiency of Thermodynamic Inhibitors for Melting Gas Hydrates," Master's Thesis, Norwegian University of Science and Technology, Trondheim, Norway.

* cited by examiner

METHOD OF GENERATING A NON-PLUGGING HYDRATE SLURRY

CROSS REFERENCE TO RELATED APPLICATIONS

This application is the National Stage of International Application No. PCT/US07/04736, filed 22 Feb. 2007 which claims the benefit of U.S. Provisional Application No. 60/782,449, filed 15 Mar. 2006 and the benefit of U.S. Provisional Application 60/899,000, filed 2 Feb. 2007.

BACKGROUND OF THE INVENTION

1. Field of the Invention

Embodiments of the present invention relate to seeding and/or making of dry hydrates and avoiding wax deposition without the aid of chemicals and with minimum use of rotating or other energized equipment. Other embodiments relate to the prevention of hydrate agglomeration and the prevention of wax deposition in a pipeline. The invention also relates to elimination of the use of energized equipment for melting, grinding or scraping hydrate solids and deposited waxes from inside of pipelines or flowlines. Also eliminated is the need for any recycle loops. In yet another embodiment there is no need for splitting the wellstream into two streams. In another aspect, the invention also avoids the use of rotating or other mechanized equipment that require remote vehicle intervention for maintenance and repair in subsea operations. In addition, embodiments of the invention eliminate the need for dual flowlines. Still other embodiments relate to the elimination of the need for heating or insulating flowlines for hydrate prevention and wax deposition prevention, thus reducing the cost of flowlines.

2. Discussion of Background Information

Among the most challenging problems in oil and gas production is the presence of natural gas hydrates in transport pipelines and equipment. Also very problematic is wax deposition in flow lines. Natural gas hydrate is an ice-like compound consisting of light hydrocarbon molecules encapsulated in an otherwise unstable water crystal structure. These hydrates form at high pressures and low temperatures wherever a suitable gas and water are present. Such conditions are prevalent in "cold-flow" pipelines, where the pipeline and wellstream fluids are unheated, and the wellstream fluids are allowed to flow through the pipeline at the low ambient temperatures often found in subsea environments. Cold-flow delivery of wellstream fluids is highly desirable, however, since it avoids the cost of insulating the pipeline and heating the pipeline and the contained fluids, but gas hydrate crystals can deposit on cold-flow pipeline walls and in associated equipment, and in the worst case lead to complete plugging of the system. Costly and time-consuming procedures may be needed to restore flow again in a pipeline plugged with hydrates and/or wax. In addition to the mere economic consequences, there are also numerous hazards connected to hydrate formation and removal, and there are known instances of pipeline ruptures and loss of human lives due to gas hydrates in pipelines. Although hydrate is generally thought of as a problem mostly for gas production, there is now ample evidence that it is also a significant problem for condensate and oil production systems. Wax deposition is also a costly problem when produced fluids naturally contain wax compounds, usually paraffin, that coat flow lines during liquid hydrocarbon production.

Several methods are known to prevent or eliminate hydrate formation and wax deposition, and subsequent problems in pipelines, valves and other production equipment, such as, for example, the processes disclosed in U.S. Patent Publication Nos. 20040176650 and 20040129609, U.S. Pat. No. 6,656,366. The article entitled "Continuous Gas Hydrate Formation Process by Static Mixing of Fluids," Paper #1010 in 5th International Conference on Gas Hydrates, Trondheim, Norway, Jun. 13-16, 2005, by Tajima et al. contains additional background information.

Current methods of preventing or eliminating hydrate plug formation using dry hydrates may involve, at a minimum, a recycle loop of dry hydrates comprising a pump and/or grinder. In such methods, the continuous recycling of even dry hydrates in a recycle loop leads to the continued growth of the hydrates and the formation of larger and larger hydrates that, if not continuously ground into smaller hydrates using a grinder or similar equipment, would ultimately grow large enough to cause plugging. Unfortunately, the pump or grinder is an energized piece of rotating equipment that can pose problems in subsea applications. There are two problems with such subsea electrical rotating equipment. First, the reliability of rotating equipment is not yet sufficient to plan for long-term operation without multiple equipment replacements during the typical lifetime of a subsea pipeline. Second, electrical power transmission is limited in distance, thus limiting the distance over which some cold flow processes are useful.

Besides the problems of energized, rotating equipment in subsea applications, other problems occur with current cold flow methods, such as fluids forming "sticky hydrates". If an unplanned shut-in occurs during the process, the reactor and possibly the main pipeline could experience a complete hydrate plug.

Some proposed solutions for generating dry hydrates for cold flow include rotating equipment, such as a pump or grinder. For example, the following have been proposed: the use of a modified pig with special pressure cleaning devices; subsea pig replacement devices operated by remote operated vehicles; high velocity, high-shear devices; mechanical scraping devices, including a rotating internal vane; near sonic pressure waves; and water hammer.

Many of the prior art methods use equipment that is not commercially proven and some of them require electricity. In addition, many require maintenance that is particularly costly in subsea applications.

Thus, there is a need for improved methods of seeding and/or making dry hydrates without the aid of continuous injection of chemicals and with minimum use of rotating or other energized equipment.

Wax deposition depends on the content of the produced or transferred fluid but usually occurs after production when the right temperature and pressure conditions are reached.

SUMMARY OF THE INVENTION

According to one aspect of the invention, a method for transporting a flow of wellstream hydrocarbons containing water through a main pipeline comprises seeding a cold-flow reactor before startup operation with dry hydrate particles, creating a dry hydrate sidestream by diverting a portion of wellstream of hydrocarbons into the reactor, wherein the wellstream hydrocarbons contains water, and feeding the dry hydrate sidestream into the main pipeline to be transported to a destination with the full wellstream. It can be readily appreciated that splitting a wellstream into two streams will be useful for retrofitting the invention to existing pipelines. In one aspect of the invention, dual flow lines will be useful for extending the cold flow process to high water cut conditions late in the field life. One flow line can be used to flow dead oil back to the well in order to reduce the water cut below 50%. Also, with respect to dry hydrates, heating may be useful on occasion on some equipment between the wellhead and the cold-flow reactor; heating is often useful with respect to timing the prevention of wax deposition. Where heating is used, insulation may be useful in some instances on some equipment between the wellhead and the cold-flow reactor.

According to another aspect of the invention, there is provided a method for transporting a flow of wellstream hydrocarbons containing water through a main pipeline, the method comprising: creating a dry hydrate slurry in a separate reactor; delivering the slurry subsea via an injection umbilical; and feeding the dry hydrate wellstream slurry to the main pipeline.

According to further aspects of the invention, the separate reactor may be located on a platform. Alternatively, the separate reactor may be located on shore. Further yet, the separate reactor may be located on a vessel. The slurry may comprise dry hydrates and a liquid of hydrocarbon. The liquid may be a portion of the wellstream to be transported. At least one static mixer may be installed in the section of the main pipeline after a point where the dry hydrate sidestream is fed into the main pipeline.

According to further aspects of the invention, the wax has an appearance temperature or deposition temperature below which it solidifies in a flowing hydrocarbon stream. The solidification is often a deposition on the inside walls of the pipe where the ambient temperature outside the pipe is below that of the hydrocarbon stream (and below deposition/appearance/solidification temperature). Thus a temperature gradient is established from the center of the pipe to the inside wall and remains for wax deposition or coating unless the normal flow, usually laminar in nature, is disturbed or changed to a turbulent flow.

According to yet another aspect of the invention, a method for transporting a flow of wellstream hydrocarbons containing water through a main pipeline comprises generating a dry hydrate sidestream slurry by diverting a portion of wellstream of hydrocarbons into a cold-flow reactor, wherein the wellstream of hydrocarbons contains water and the cold-flow reactor contains at least one static mixer, and feeding the slurry into the main pipeline to be transported to a destination with the full wellstream.

According to further aspects of the invention, the cold-flow reactor may be subsea. The method contemplates having no more than 5% of the full wellstream introduced to the cold-flow reactor to generate a dry hydrate sidestream. Alternatively, no more than 1% of the full wellstream is introduced to the cold-flow reactor to generate a dry hydrate sidestream. A particle size of the dry hydrate may be between about 1 to about 30 microns in diameter. The cold-flow reactor may be in the shape of a small diameter pipe. The cold-flow reactor may comprise alternating upward and downward flowing pipes. The alternating flowing pipes form an additional cold-flow reactor and the two cold reactors may be connected to each other. The method contemplates having about 10% of the full wellstream introduced to the additional cold-flow reactor and all diverted wellstream may be fed into the wellstream flow. Static mixers may be installed in the upward flowing pipes. At least one static mixer may be installed in the section of the main pipeline after a point where the dry hydrate sidestream is fed into the main pipeline.

According to an aspect of the invention, a method for transporting a flow of wellstream hydrocarbons containing water through a main pipeline comprises generating a dry hydrate sidestream slurry by diverting a portion of wellstream of hydrocarbons into a cold-flow reactor, the wellstream hydrocarbons containing a gas phase and a liquid phase, filling the cold-flow reactor with wellstream, the reactor comprising a gas fluid connection to a gas tank to allow gas phase in the wellstream to be separated from the liquid phase of the wellstream, and feeding the slurry into the main pipeline to be transported to a destination with the full wellstream.

According to another aspect of the invention, a method for transporting a flow of wellstream hydrocarbons containing water through a main pipeline comprises generating a dry hydrate sidestream slurry by diverting a portion of wellstream of hydrocarbons into a cold-flow reactor, wherein the reactor is a falling film reactor, and feeding the slurry into the main pipeline to be transported to a destination with the full wellstream.

According to further aspects of the invention, the diverted portion of wellstream may be injected into the cold-flow reactor along the walls of the reactor. The method further contemplates injecting water and high pressure gas into the falling film reactor to form the dry hydrate along the walls of the reactor. The injected water and gas may be separated from the dry hydrate sidestream slurry before the slurry is fed into the main pipeline. At least one static mixer may be installed in the section of the main pipeline after a point where the dry hydrate sidestream is fed into the main pipeline.

According to yet another aspect of the invention, a method for transporting a flow of wellstream hydrocarbons containing water through a main pipeline comprises generating a dry hydrate sidestream slurry by diverting a portion of wellstream of hydrocarbons into a cold-flow reactor, wherein the wellstream hydrocarbons contains water and the cold-flow reactor is a pipe with roughened walls, and feeding the slurry into the main pipeline to be transported to a destination with the full wellstream.

According to a further aspect of the invention, a system for transporting a flow of wellstream hydrocarbons containing water comprises a main pipeline, and a cold-flow reactor installed in a pipe or tube connected to the main pipeline. Either a portion or all of the wellstream is fed through the cold-flow reactor. The system is substantially free of energized equipment.

According to an aspect of the invention, a system for transporting a flow of wellstream hydrocarbons containing water comprises a main pipeline, and an injection umbilical connected to a facility above sea level. Alternatively, a cold-flow reactor is installed subsea and a pipe or tube is connected to the main pipeline, wherein a portion of the wellstream is fed through the cold-flow reactor. The system is substantially free of energized equipment.

According to another aspect of the invention, a system for transporting a flow of wellstream hydrocarbons containing water comprises a main pipeline and a pipe or tube connected to the main pipeline, wherein a portion of the wellstream is fed through the cold-flow reactor. The system is substantially free of energized equipment. The cold-flow reactor comprises at least one static mixer.

According to a further aspect of the invention, a system for transporting a flow of wellstream hydrocarbons containing water comprises a main pipeline and a cold-flow reactor installed in a pipe or tube connected to the main pipeline, wherein a portion of the wellstream is fed through the cold-flow reactor, wherein the system is substantially free of energized equipment and the cold-flow reactor comprises a gas fluid connection to a gas tank.

According to yet another aspect of the invention, a system for transporting a flow of wellstream hydrocarbons containing water comprises a main pipeline and a cold-flow reactor installed in a pipe or tube connected to the main pipeline, wherein a portion of the wellstream is fed through the cold-flow reactor, wherein the system is substantially free of energized equipment, and the cold-flow reactor comprises a falling film reactor.

According to yet a further aspect of the invention, a system for transporting a flow of wellstream hydrocarbons containing water comprises a main pipeline and a pipe or tube connected to the main pipeline, wherein a portion of the wellstream is fed through the cold-flow reactor, wherein the system is substantially free of energized equipment, and the pipe or tube has roughened walls.

According to yet another aspect of the invention, a method for producing hydrocarbons comprises any one or a number of the above methods and systems for transporting hydrocarbons once the hydrocarbons are produced from the wellhead. The hydrocarbons are preferably greater than 50% of the total liquid volume. Gas phase hydrocarbons are most preferably less than 50% of the total pipe volume.

In still further embodiments, there is provided a method of producing dry hydrates, comprising: passing a hydrocarbon stream comprising water and one or more hydrate-forming gases through a cold-flow reactor, said cold-flow reactor having one or more static mixers disposed therein; reducing the droplet size of said water in said hydrocarbon stream by passing said hydrocarbon stream through said one or more static mixers; and converting at least a portion of said water into dry hydrates. The cold-flow reactor can be positioned within or form part of a pipeline for transporting the hydrocarbons. Alternatively, the cold-flow reactor can be positioned external to the pipeline for transporting the hydrocarbons, in which case the cold-flow reactor receives a sidestream of the hydrocarbons.

According to yet another aspect of the invention, there is provided a method of avoiding wax deposition and rendering a pumpable fluid of liquid hydrocarbon and wax components, comprising conveying said fluid through a pipe connected to a reactor comprising a static mixer and through said reactor before and while the fluid temperature drops below the wax appearance temperature. The fluids are mixed by their action in the area of the static mixer(s), resulting in fine wax solids that are conveyed with the fluid rather than coated/deposited on the pipe wall. The fluids are then conveyed to a processing facility without materially increasing the fluid viscosity.

The static mixers, when positioned appropriately, disturb the generally normal laminar type flow that would otherwise permit wax deposition on the pipe walls, and create turbulent flow that retains formed wax particles in the flowing fluid.

A heat exchanger may be used near a wellhead or other source of fluid so as to define the wax precipitation pressure/temperature regime near such wellhead or source. Thus, the static mixer(s) can be positioned in the region to force wax particle formation and avoid deposition on pipeline walls. Further the produced stream could be subjected to the static mixer(s) in the region within about a kilometer, or one-half kilometer, or one-third kilometer of the source, usually about five minutes or seven minutes, or ten minutes of flow time and distance. This can be used for production or distribution pipelines and has great applicability to both subsea and arctic environments.

Anti-agglomerates are useful for shut-in although chemicals are not generally used during steady flow through the invention.

Other exemplary embodiments and advantages of the present invention may be ascertained by reviewing the present disclosure and the accompanying drawings.

BRIEF DESCRIPTION OF THE FIGURES

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION

Figure 1:
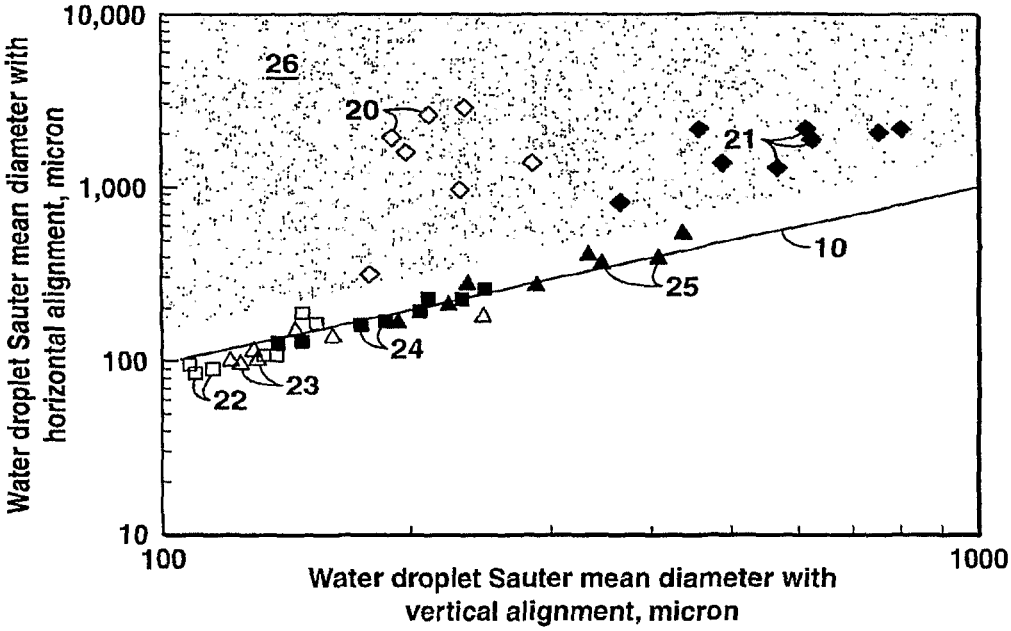
FIG. 1 illustrates a parity plot for water droplet Sauter mean diameter at two static mixer alignments.

In the following detailed description, the specific embodiments of the present invention are described in connection with its preferred embodiments. However, to the extent that the following description is specific to a particular embodiment or a particular use of the present techniques, it is intended to be illustrative only and merely provides a concise description of the exemplary embodiments. Accordingly, the invention is not limited to the specific embodiments described below, but rather; the invention includes all alternatives, modifications, and equivalents falling within the true scope of the appended claims.

The present invention provides the use of dry hydrates and solidifying wax in a way that does not present problems associated with prior art teachings. The present invention also provides methods of seeding and/or making of dry hydrates without the aid of chemicals and with minimum use of rotating or other energized equipment.

The present invention is further demonstrated with the following embodiments.

In one embodiment of the present invention, small diameter, dry hydrate particles are placed in a reactor pipe or tube adapted to be placed in fluid communication with a wellstream before startup. The dry hydrate particles are used to seed the full wellstream. A small fraction of the full wellstream is passed once through a cold-flow reactor. The dry hydrates could be loaded during or after construction of the pipeline, before operating the wet wellstream or before the wellstream starts producing water. Contrary to the common view of avoiding placing hydrates in a pipeline on purpose because of the general notion that hydrates in a shut-in pipeline might fuse into one large hydrate mass that would plug the pipeline, the present invention proves that the advantage of providing seed of dry hydrate is that the facility can be started using the same process that is designed for re-start after planned and unplanned shut-ins. The dry hydrates useful in this embodiment may be formed using any suitable method for forming dry hydrate particles. In one or more embodiments, the dry hydrates are formed using a small-diameter pipe and/or a static mixer as described herein. Unlike other methods for delivering dry hydrate particles to wellstreams, the dry hydrate particles in the instant embodiment are not recycled in a loop. As explained above, the continuous recycling of even dry hydrates in a loop containing liquid water leads to the continued growth of the hydrates and the formation of larger and larger hydrates that, if not continuously ground into smaller hydrates using a grinder or similar equipment, would ultimately grow large enough to cause plugging. Thus, in one or more embodiments, the present invention is any of the other embodiments described herein where the dry hydrates are formed without recycling hydrates in a recycle loop.

In one or more other embodiments of the present invention, equipment, such as manifolds, valves, vessels, pipelines, jumpers, etc., may be pre-filled with a dry hydrate slurry during subsea installation by providing for pressure and low temperature to be maintained in the equipment during installation. The dry hydrate slurry would be preserved by the low temperature and high pressure until the time to start up the production flowline. As dry hydrate slurries do not agglomerate under such conditions in the absence of a recycle loop, there is no difficulty maintaining fluid flow at startup. Therefore, the present invention could be employed with several different types of processes for hydrate management, including chemical injection, insulated pipe, cold flow processes of any kind, etc.

Figure 6:
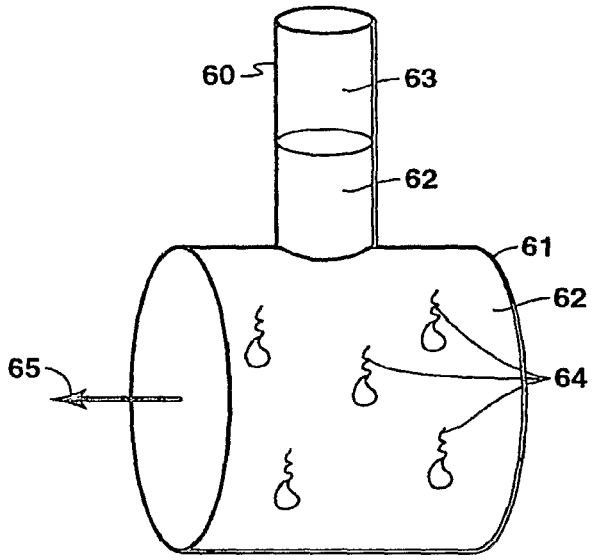
FIG. 6 illustrates the dendritic growth of hydrates on water droplets in a cold-flow reactor according to one or more embodiments of the present invention.

In another embodiment, dry hydrates are delivered to the cold-flow reactor subsea through a chemical injection umbilical. The dry hydrates could be formed in a separate reactor not associated or connected to the main pipelines for the wellstream. For example, FIG. 6 illustrates connections and equipment that may be employed in this embodiment of the present invention. The separate reactor may be on a platform or onshore or in an FPSO-type vessel, exemplified generally in FIG. 6 by utility floater 1. The dry hydrates are carried through umbilical 2*a* in a liquid hydrocarbon stream to provide good slurry flow characteristics. The pressure and temperature of the fluids in the umbilical are maintained within the hydrate stability parameters. This can be accomplished by using fluids from the wellstream to be treated or using a fluid that is best suited for the pressure-temperature envelope of the umbilical. The quantity of dry hydrates delivered by the umbilical is small compared to the full wellstream volume. The dry hydrates are delivered to subsea manifold 3 which is in fluid communication with well 4 and pipeline 5. Manifold fluids are delivered to the reactor in utility floater 1 through umbilical 2*b*. Alternatively, instead of vertical umbilical delivery of fluids to a floater and solid dry hydrates returning to the pipeline, one can have the standard single umbilical that is used to deliver injectants from the facility near the outlet of the pipeline to the injection point near the well. Fluids removed from the pipeline at the processing facility would be used to generate a slurry of dry hydrates which would be delivered through the single umbilical to the injection point near the well. No additional storage facilities are required for chemical injectants because the injectant is water, oil and natural gas which are found at the processing facility.

In one or more additional embodiments of the present invention, dry hydrates are generated subsea in a cold-flow reactor using static mixers. In one or more embodiments, the cold-flow reactor can be a small-diameter pipe having a diameter of about 0.5-10 cm, preferably about 0.5-5 cm, and more preferably about 1-3 cm. The static mixer forms small water dispersions in oil that result in rapid conversion of water to hydrates without agglomeration. Alternatively, small water droplet dispersions can be formed by flowing a full wellstream through a nozzle. However, a nozzle would result in a very large differential pressure.

No large differential pressure results from static mixing or from "sticky" hydrates, since the latter are not present. Unexpected shut-ins can be handled several ways. For example, the static mixing segment of the dry hydrate reactor can be placed above the full wellstream pipe at the point where fluids are sampled for the dry hydrate reactor. If the static mixer is in an inclined position relative to the outlet of the dry hydrate reactor, dry hydrates will slump to the reactor inlet. Liquid water will drain back into the full wellstream pipe. In another example, the small-diameter pipe of the dry hydrate reactor can be lower than and displaced by the dry hydrated full wellstream downstream of the point where the seeds and the full wellstream mix. Dry hydrates can be re-started with the normal pipeline operating pressure. There is no need to depressurize the pipeline and restart at low pressure to avoid solid hydrate deposition and plugging. An advantage of static mixers is that the seed cold-flow reactor will not need to be operated at low volumetric gas fraction to be effective in generating dry hydrates with static mixers. The cold-flow reactor containing the static mixer or mixers can be in fluid communication with the wellstream through a sidestream taken from the wellstream either directly or indirectly. Alternatively, if the gas concentration is sufficiently low, the static mixer can be placed directly in the wellstream itself. In this embodiment, a portion of the wellstream pipeline itself serves as the cold-flow reactor for forming the dry hydrates. In one or more embodiments the gas volume fraction is less than 10 percent of full wellstream without static mixers. The gas volume fraction can be between about 0-50% with static mixers.

In one or more additional embodiments of the present invention, dry hydrates are generated subsea in a cold flow reactor section of the main pipeline using static mixers. In one or more embodiments, the cold-flow reactor section can be one or more static mixers. The static mixer forms small water dispersions in oil that result in rapid conversion of water to hydrates without agglomeration. Gas is also dispersed by the static mixer(s), thus avoiding other mechanisms of forming sticky hydrates. No large differential pressure results from static mixing or from "sticky" hydrates, since the latter are not present.

Unexpected shut-ins can be handled several ways. For example, thermodynamic inhibitors, such as methanol or glycols, may be injected upstream and/or downstream of the static mixing segment of the main pipeline before planned shut-in, during shut-in and/or after startup. Alternatively, low dose hydrate inhibitors may be injected upstream and/or downstream of the static mixing segment of the main pipeline before planned shut-in, during shut-in and/or after startup. Specifically, an anti-agglomerate may be injected before, during and/or after shut-in to facilitate hydrate slurry formation.

The main pipeline may split into two sections: (1) A cold flow section with static mixers or other dry hydrate generating equipment and (2) an unobstructed pipeline section for the purpose of bypassing the cold flow section while pigging the main pipeline. An advantage of static mixers is that the cold-flow reactor section will not need to be operated at low volumetric gas fraction to be effective in generating dry hydrates with static mixers. In this embodiment, the cold-flow reactor containing the static mixer or mixers receives most or all of the fluid in the full wellstream directly from the pipeline. In this embodiment, a portion of the wellstream pipeline itself serves as the cold-flow reactor for forming the dry hydrates. The static mixers used according to embodiments of the present invention serve to disperse the water and the gas in the wellstream fluids into smaller water and gas droplets that are relatively quickly and completely converted into dry hydrates without requiring seed hydrates. That is, the hydrates are formed directly in the full wellstream without a sidestream generator/reactor. Gas and/or water separation may be included in the main pipeline before the cold flow generating section.

The static mixers used according to embodiments of the present invention serve to disperse the water and the gas in the wellstream fluids into smaller water and gas droplets that are relatively quickly and completely converted into dry hydrates without recycling the hydrates. That is, the hydrates are formed and then placed directly into the wellstream without being circulated in a recycle loop.

Water droplet diameter has been determined to affect dry hydrate formation. When there is no gas phase, the water does not have to be dispersed in 1-30 micron droplets to form dry hydrates. Smaller water droplet diameters are believed to be generally better for dry hydrate formation, but it is believed that a wide range of water droplet diameters may be employed. Thus, in one or more embodiments, the dry hydrates used in embodiments of the present invention are formed using water droplets having diameters less than or equal to about 30 microns, or less than or equal to about 15 microns, or less than or equal to about 10 microns, or less than or equal to about 7 microns. Droplet diameter is known to depend on the droplet and continuous phase viscosity, shear rate (or fluid velocity), and interfacial tension between the droplet and continuous phase. In a static mixer, the droplet diameter is decreased because shear rate is increased. The relationship between droplet diameter and the above factors is well known to those of skill in the art and can be calculated using known relationships.

The water droplets tend to coalesce downstream of the static mixer section. Gravity is a strong promoter of coalescence, so the whole reactor preferably contains static mixers, the reactor preferably should be oriented vertically, or the reactor diameter may be made as large as practical to minimize coalescence during the hydrate formation stage. Filling the entire line with mixers can impose unnecessary pressure drop. Shorter settle distances in the horizontal pipe are conducive to greater droplet coalescence, so proportionally little is gained by increased pipe diameter. Therefore, vertical orientation is the preferred method, though combinations of methods could be implemented. FIG. 1 shows a parity plot that compares water droplet size for vertical and horizontal orientation of the static mixer and subsequent tube section for a variety of oils or other hydrocarbons. Reference line 10 represents the 45-degree line for the plot. The symbols exemplified by points 20, 21, 22, 23, 24 and 25 show the plotted results for, respectively: Conroe crude oil, 2 m/s; dodecane, 2 m/s; Conroe crude oil, 10 m/s; Conroe crude oil, 5 m/s; dodecane 10 m/s; and dodecane 5 m/s. The shaded area in FIG. 1 denoted by reference numeral 26 represents the area of significant coalescence of droplets. As can be seen from FIG. 1, the vertically oriented static mixers maintain smaller droplet sizes more effectively than the horizontally oriented mixers.

Figure 2:
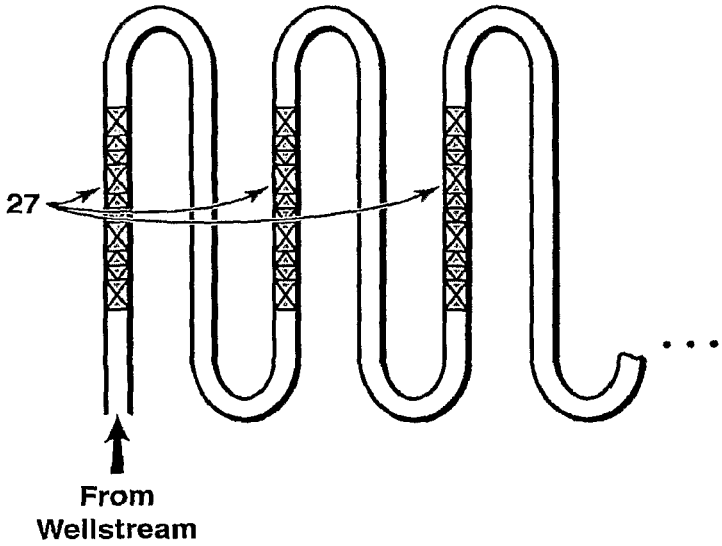
FIG. 2 illustrates the staging of alternating upward-downward flowing sections of a dry hydrate reactor.

To effectively package a vertically oriented static mixer assembly in the distance that may be required for complete or nearly complete hydrate formation, one or more embodiments of the present invention may employ staging of alternating upward-downward flowing section in a dry hydrate reactor. Such an embodiment is illustrated in FIG. 2, which shows a series of bundled sections having upward flow sections with static mixer elements 27, followed by downward flow sections with no elements. Partial or nearly complete hydrate formation can be accomplished horizontally with much fewer static mixers and much less distance than can complete conversion by static mixers. However, once dry hydrates are initiated, if the flow is at high Reynolds Number, there is not necessarily a need for more static mixers to complete the formation of hydrates to 100%.

Figure 3:
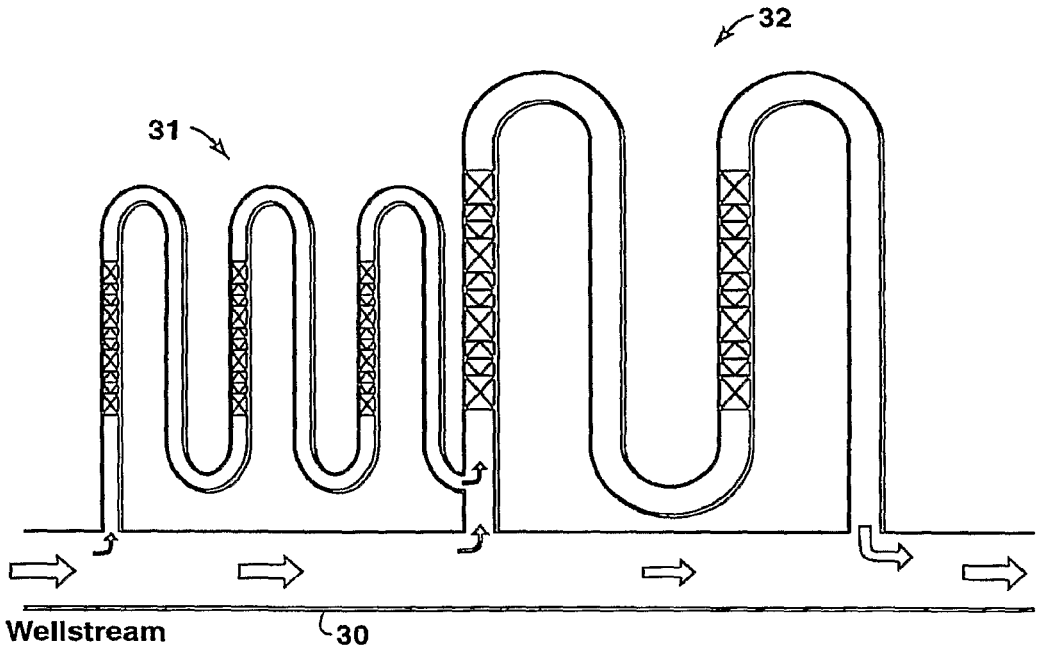
FIG. 3 illustrates a staged 3-reactor design for creating a dry hydrate sidestream.
Figure 4:
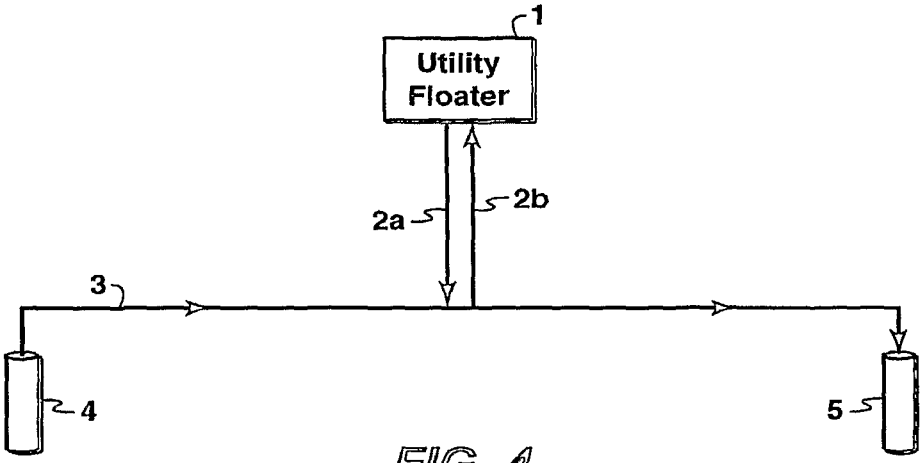
FIG. 4 illustrates a utility floater umbilical to deliver dry hydrate to the wellstream.

A dry seed scale-up design according to one or more embodiments of the present invention may involve multiple staged reactors of increasing capacity. Staging would ensure the most effective conversion of all water in the wellstream to dry hydrate. An example of such an embodiment employing a three reactor design is shown in FIG. 3. In the three-reactor design, first reactor 31 takes approximately 1% of the liquids in wellstream 30 and converts the side-stream water to dry hydrate. Following first reactor 31 is a secondary reactor 32, where an additional 10% of wellstream liquids are diverted. The dry hydrate stream from the first reactor is fed into the second reactor to induce faster dry hydrate formation. Finally, the dry hydrate stream is fed back into the wellstream (the third reactor), which induces conversion of the remaining water to dry hydrate. The advantage of the staged reactor design is that greater heat and mass transfer can be obtained and smaller droplets maintained in the side streams, resulting in faster and more complete conversion of the water to dry hydrate.

Water droplet surface area is maximized by maximizing the fluid flow rate through the static mixer reactor section, or in other words, increasing the Reynolds number. This requirement may lead to preference for small diameter vertical static mixer reactor designs versus large diameter horizontal reactors.

Figure 5:
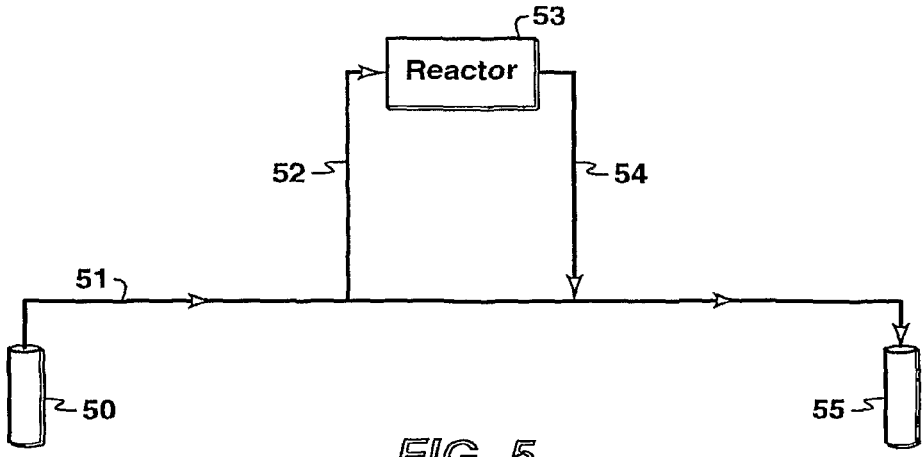
FIG. 5 illustrates a simplified approach to dry hydrate reactor.

FIG. 5 shows a seed reactor design to initiate dry hydrate growth according to one embodiment of the invention. The design has the advantage that it is relatively simple, imposes no high-maintenance equipment, and doesn't enter a regime of "sticky" hydrate formation. Production fluids from well 50 enter manifold 51. Less than about 5%, alternatively less than about 1%, of the wellstream is diverted through sidestream 52 to dry hydrate reactor 53, which may include static mixers as described above, or it may be a small-diameter pipe without static mixers. The water in the wellstream fluids entering cold-flow reactor 53 is used to form dry hydrate particles that are in turn fed back into the wellstream through return stream 54. In one or more embodiments, the dry hydrate particles have a diameter of about 1-30 microns, or about 1-20 microns, or about 1-10 microns, or about 1-5 micron. Upon introduction into the wellstream fluids in manifold 51 the dry hydrate particles will act as seed nuclei to cause the formation of dry hydrates in the wellstream fluid having diameters in the range of about 10-100 microns. In this way, the water in the full wellstream is converted into dry hydrates. The wellstream fluid containing the dry hydrates is then fed to pipeline 55.

Figure 11:
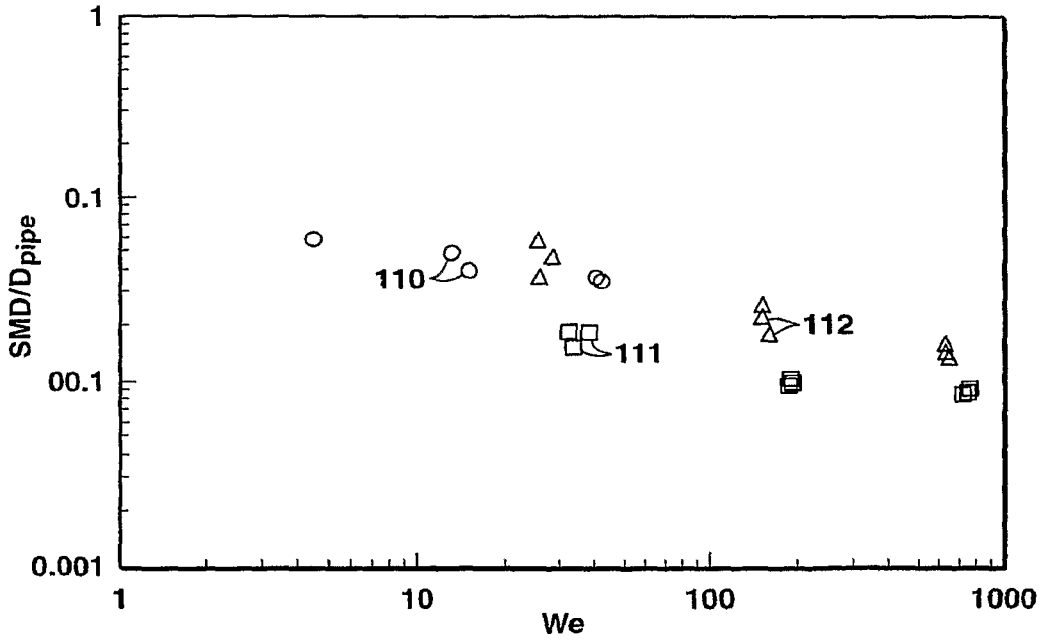
FIG. 11 illustrates the ratio of Sauter mean diameter (SMD) to pipe diameter produced with a static mixer as a function of Weber number (We) for various liquid-liquid dispersions.

In "Continuous formation of $CO_2$ hydrate via a Kenics-type static mixer," Energy & Fuels, Vol. 18, pp. 1451-1456, 2004, author Tajima et al. published data for mean droplet diameter with Weber number for a stream of $CO_2$ in water (without a liquid hydrocarbon), from which a pumpable hydrate slurry was obtained for $CO_2$ sequestration in the ocean. Using a Lasentec® D600X particle size analyzer, water droplet distributions were measured, by the present inventors, as a function of the Weber number in both dodecane and in a crude oil, as shown in FIG. 11, with the Tajima et al. results. The data for water dispersions in oil is comparable to that of the $CO_2$ dispersions, indicating that the static mixer disperses the water droplets in oil as efficiently as with $CO_2$ in water. Referring to FIG. 11, the data points exemplified by points 110 represent the results reported by Tajima et al. for carbon dioxide in water, the data points exemplified by points 111 represent the results obtained by the present inventors for water in Conroe crude oil, and the data points exemplified by points 112 represent the results obtained by the present inventors for water in dodecane.

Figure 12:
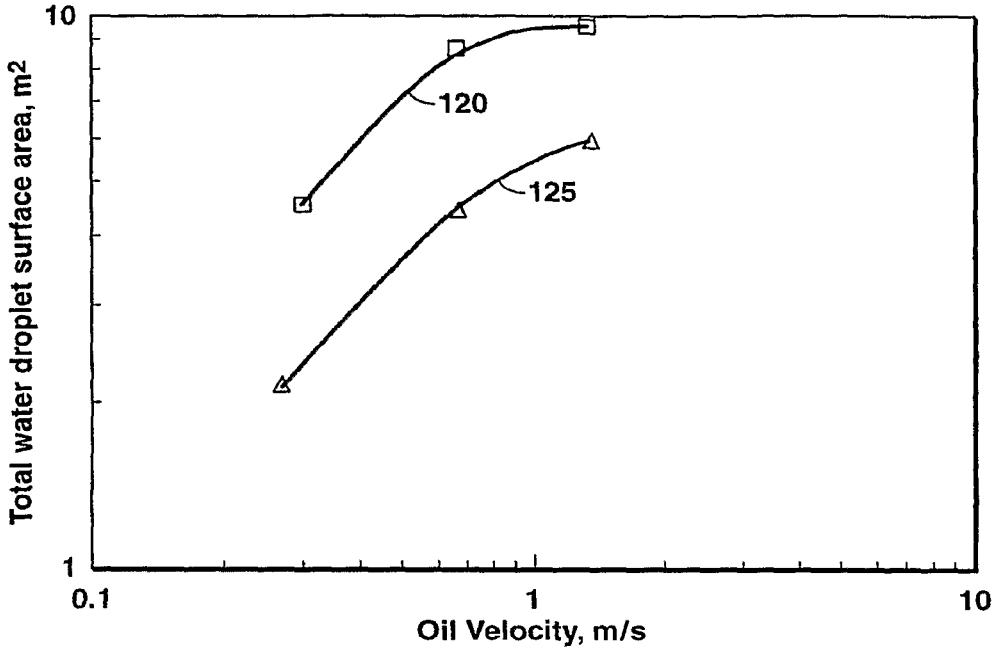
FIG. 12 illustrates total Water droplet surface area with oil velocity at the outlet of a 5 element static mixer.
Figure 13:
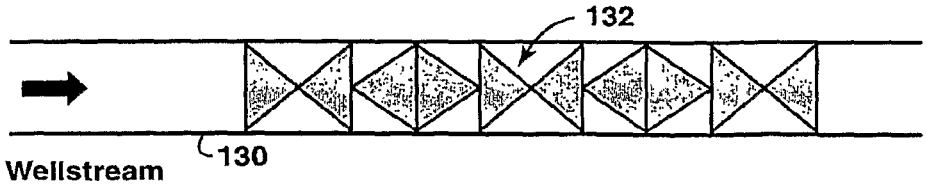
FIG. 13 illustrates location of a static mixer in a main pipeline for transportation of hydrocarbons.

FIG. 12 shows that the total droplet surface area increases with velocity through the static mixers. The increased droplet surface area permits greater conversion of water and is conducive to dry hydrate growth. Referring to FIG. 12, curves 120 and 125 represent the total water droplet surface area versus oil velocity (at the outlet of a five-element static mixer) for Conroe crude oil and dodecane, respectively.

In another embodiment of the present invention, dry hydrates are generated subsea in a small-diameter pipe cold-flow reactor by excluding most of the gas phase. This is done by passive separation of liquids from gas. The hydrates formed by this method are not sticky. The low gas fluid forms small hydrate particles that disperse in oil with rapid conversion of water to hydrates without agglomeration. No large differential pressure results were observed in this embodiment of the present invention. Since "sticky" hydrates were not generated, no large differential pressure was observed. Unexpected shut-ins can be handled in several ways. For example, the dry hydrate seed reactor can be placed above the full wellstream pipe at the point where fluids are sampled for the dry hydrate reactor. If most of the reactor inclines in the direction of flow toward the outlet of the dry hydrate reactor, dry hydrates will slump to the reactor inlet. Liquid water will drain back into the full wellstream pipe. Another example: the small-diameter pipe of the dry hydrate reactor can be lower than and displaced by the dry hydrated full wellstream downstream of the point where the seeds and the full wellstream mix. Dry hydrates can be re-started with the normal pipeline operating pressure. Dry hydrates can be held in the reactor by way of standard gate valves such as are in use in most petroleum pipelines.

One advantage of this embodiment is the elimination of the pressure drop anticipated with the use of the static mixers.

The use of an ultra-low gas volume in a pipe where oil and water are flowing to form small diameter hydrates is believed to provide unexpected results.

Figure 7:
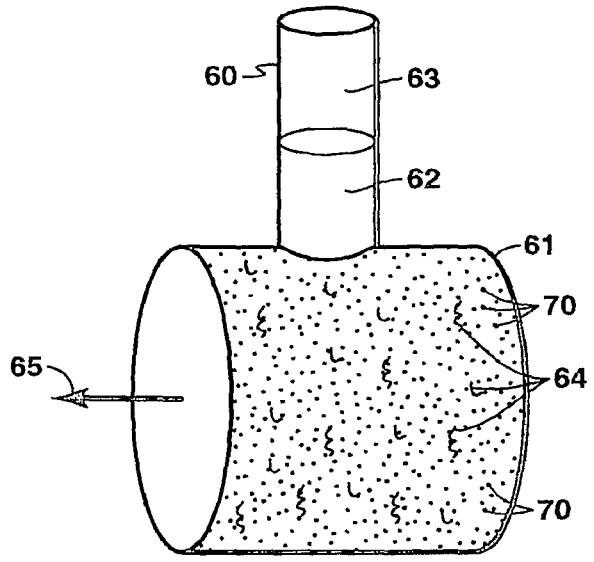
FIG. 7 illustrates the dendrites as separated from the water droplets shown in FIG. 6.

In one such embodiment, the pipe is preferably over-filled (95% oil and 5% water) to eliminate the gas/water interface and hydrate plug formation. Dendritic hydrate formation can be forced by mass transfer limiting the gas phase in the oil phase. As shown in FIG. 6, dendrites forming on the water droplets do not contact a gas/water interface, since there is no separate gas phase. In FIG. 6, pipe 60 connects pipe 61 to a gas reservoir (or other hydrocarbon reservoir). Pipe 60 contains oil 62 over which a gas 63, for example methane or natural gas, is placed. Hydrate dendrites 64 are shown growing on water droplets. The direction of turbulent flow is indicated by arrow 65. Referring now to FIG. 7, turbulent flow then causes the dendrites to separate from the water droplets. Turbulent flow eventually results in the dendrites 64 breaking off of the water droplets and ultimately into small granules 70. Total water conversion to hydrates occurs without hydrate agglomeration.

In flow loop experiments where a gas space is present above the liquid volume, "sticky" hydrates are formed. The "sticky" hydrates appear as large slush-like aggregates that induce large pressure drops across the loop.

In surprising contrast, dry hydrates are observed to form when little or no gas phase is present at the same formation conditions. These have the appearance of fine silt which would settle out when the fluid flow is stopped. While producing these dry hydrates, very little increase of pressure drop occurred across the loop.

In yet another embodiment, the present invention provides another passive method of forming small diameter dry hydrates by using a falling film reactor as the cold-flow reactor. The design of falling film reactors is well known in the chemical industry. For example, most detergents are manufactured in falling film reactors. There are both large scale and micro-reactor-scale falling film reactor designs. All of these reactors have the advantage of large surface-to-volume ratio that allows for enhanced process control and heat management. Various reactor designs incorporate single tubes, multi-tubes and parallel plates. Hydrates formed by a falling film of water, oil and gas will be small in diameter. Falling film reactors have no moving parts, making this process highly reliable for subsea application.

Figure 8:
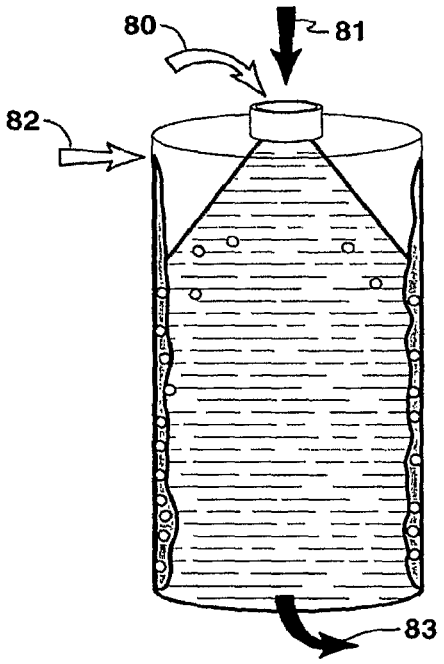
FIG. 8 illustrates a falling film dry hydrate seed reactor.

FIG. 8 shows another embodiment of the present invention in which a dry hydrate seed falling film reactor has oil injected along the walls of the reactor. A water stream is injected as a mist by high pressure gas, which instigates water-limited hydrate growth. The falling oil film captures the dry hydrate seeds and delivers them to the wellstream, free of gas bubbles. Referring to FIG. 8, water and high pressure gas, indicated by reference numerals 80 and 81 respectively, are introduced into the top of the falling film reactor. Oil 82 is injected along the walls of the reactor. The dry hydrates in the falling oil film flow out from the reactor at 83.

The energy required for a falling film reactor can be provided by the temperatures of the reacting fluids by maintaining proper fluid flow ratios. An energy balance on a closed, falling film reactor can be determined using equations and methods well known to those of skill in the art. Such energy balance calculations show that the closed reactor system can be designed to produce hydrate without dependence on outside convection. A reactor would convey heat to the surroundings, and could be engineered with exterior fins to maximize convection.

In another embodiment of the present invention, static mixers are used for mixing the seed hydrates with the full wellstream being seeded in order to achieve maximum mass transfer and heat transfer for efficient conversion of water to hydrates. This process uses a static mixer in the main pipeline at the point where dry seed hydrates, produced by any of the embodiments discussed above, are combined with the full wellstream. This will result in more rapid dispersion of the liquid water with the dry hydrate seeds, avoiding possible large hydrate masses being formed due to poor mixing of the two streams or poor heat transfer during hydrate formation in the main pipeline.

Figure 9:
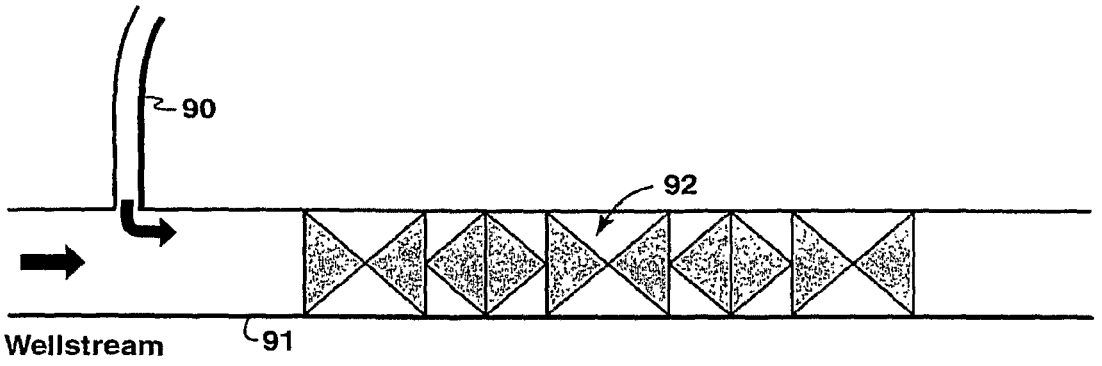
FIG. 9 illustrates a static mixer in a main pipeline to increase heat and mass transfer during dry hydrate production.

FIG. 9 illustrates another embodiment of the invention involving the application of a static mixer in the main pipeline to increase heat transfer and mass transfer just downstream of dry hydrate injection. The dry hydrate can be injected through an umbilical or could be an input from a seed reactor. In FIG. 9, dry hydrate seeds are introduced through inlet pipe 90 into wellstream fluids flowing in pipeline 91. Static mixers 92 are placed downstream of inlet pipe 90. As is well known in the art, the addition of static mixers could account for as much as 300% increase in heat transfer compared to a system with no mixers (see, e.g., "Static mixing and heat transfer" by C. D. Grace in Chemical and Process Engineering, pp. 57-59, 1971.) Therefore, by addition of static mixers, the reactor length could be reduced to ⅓ the required length in the case where no static mixers were used, while achieving the same heat transfer rates.

Figure 10:
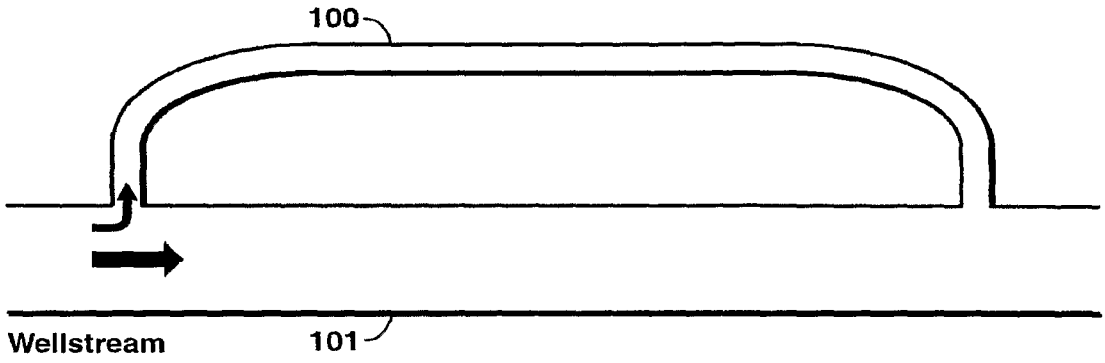
FIG. 10 illustrates a rough-walled tube hydrate seed reactor.

In another embodiment, the present invention provides a small rough-walled pipe to achieve the same result as static mixers, i.e., high shear fields for small droplet formation. The same pipe may be of the same sizes as the pipe discussed above with regard to static mixers in the cold-flow reactor concept. FIG. 10 shows an example of such an embodiment for the implementation of rough-walled tubing to cause mass transfer increase during hydrate formation. Higher shear at the wall will cause water droplets to be broken into smaller droplets, thereby increasing mass transfer. Referring to FIG. 10, a rough-walled tube 100 is joined to pipeline 101 as shown. A sidestream of the wellstream fluids is taken from pipeline 101 and flows into rough-walled pipe 100. The sidestream ultimately rejoins the wellstream fluid flow downstream of the point at which the sidestream enters rough-walled tube 100.

The pressure drop per unit length that results from a dodecane suspension flowing in a tube can be readily determined as a function of Re (Reynolds number) at several We (Weber number) by those of skill in the art. As can be determined from FIG. 11 at We>200 the droplet size does not change significantly. Therefore, in one or more embodiments of the present invention, the rough-walled tube will have a sufficiently small diameter that We of at least 200 is produced.

As an example of the foregoing, if a 600 ft long reactor was used, in a ½ inch diameter reactor, the flow rate at We=200 would be 2.23 ft/s and Re=7350. The pressure drop across a reactor would be 114 psi. The residence time of fluid in the reactor would be 5 minutes. Freer et al. in "Methane hydrate film growth kinetics," Vol. 185, pp. 65-75, 2001 measured methane hydrate film growth rates of 325 micron/s at 38° F. and 1314 psia. Therefore, 100 micron diameter droplets should be consumed on the order of a second and should have sufficient time for conversion.

The formation of dry hydrates and the growth of such hydrates are affected by many factors. The gas composition in the reactor and the pipeline preferably does not change during hydrate formation as this may decrease the thermodynamic potential and kinetic driving force for hydrate formation, thereby slowing the hydrate formation rate and requiring that the reactor be designed much longer than otherwise expected. The following factors play a large role in whether composition changes significantly: 1) operating pressure (the higher the better; preferably greater than 3000 psig); 2) water cut (the lower the better; preferably less than 10 volume %); and 3) initial gas composition (the closer to composition in the hydrate, the better; preferably greater than 8 mole % ethane, propane, butanes and/or pentanes).

High operating pressures are preferred since proportionally smaller mole fractions of gas are consumed for the same amount of hydrate formed. Lower water cut results in less hydrate formed, so smaller mole fractions of gas are consumed. The azeotrope condition is where hydrate is consuming the gas in the same proportion as the gas composition, resulting in no composition change.

The hydrate gas fraction (whether dissolved in liquid oil or present as a gas phase) is preferably sufficient to convert all of the water in the reactor to dry hydrates. The preferred condition is for the hydrate gas components to be dissolved in the oil phase. The reason is that large gas bubbles in the reactor may lead to large hydrate particles that trap liquid water that is not completely converted to hydrates, resulting in "sticky" hydrates. Either the water quantity is preferably less than the dissolved hydrate gases can convert to hydrates or the oil is preferably capable of being re-saturated with hydrate gases before the fluids exit the reactor. Therefore, a seed reactor design will take into account the rate of consumption of hydrate gases dissolved in the liquid and the rate of re-saturation of the oil.

Preferably, the temperature of the dry hydrate reactor balances the need to keep the reactor short by using as low a temperature as is possible, and keeping the hydrate formation rate slow enough to avoid agglomeration of partially converted water droplets. Similarly, the temperature of the mixing zone of dry hydrate seeds with the full wellstream liquid water is crucial as the liquid water is preferably prevented from forming sticky hydrates faster than the dry hydrate seeds convert the liquid water to dry hydrates.

In another aspect of the invention, any one or a number of the above methods and systems for transporting hydrocarbons can be used in a method or system to produce hydrocarbons from the wellhead. The hydrocarbons are preferably in liquid form and 50% or more of the total liquid volume is hydrocarbon and less than 50% of the total pipeline volume is gas. In yet another embodiment, the present invention is a method of producing hydrocarbons, comprising: providing a well in a hydrocarbon reservoir; producing a wellstream comprising hydrocarbons and water from said well; diverting a sidestream of said wellstream into a cold-flow reactor, said cold-flow reactor having one or more static mixers positioned therein; passing said sidestream through said one or more static mixers; converting at least a portion of the water in said sidestream to dry hydrates without recycling said dry hydrates through said cold-flow reactor or through said one or more static mixers; feeding said dry hydrates into said wellstream to convert substantially all of the water in said wellstream to dry hydrates, thereby forming a wellstream comprising dry hydrates and hydrocarbons; transporting said wellstream comprising dry hydrates and hydrocarbons through a pipeline; recovering said hydrocarbons from said pipeline. It has been observed that when dry hydrate seeds are combined with a stream containing liquid water, the seed particle diameters grow proportionally to the cube root of the water-to-seed volume ratio.

In still another embodiment, the present invention provides a method of producing hydrocarbons, comprising: providing a well in a hydrocarbon reservoir; producing a wellstream comprising hydrocarbons and water from said well; diverting a sidestream of said wellstream into a cold-flow reactor; converting at least a portion of the water in said sidestream to dry hydrates without recycling said dry hydrates through said cold-flow reactor; feeding said dry hydrates into said wellstream to convert substantially all of the water in said wellstream to dry hydrates, thereby forming a wellstream comprising dry hydrates and hydrocarbons; transporting said wellstream comprising dry hydrates and hydrocarbons through a pipeline; recovering said hydrocarbons from said pipeline.

In yet further embodiments, there is provided a method of producing hydrocarbons, comprising: providing a well in a hydrocarbon reservoir; producing a wellstream comprising hydrocarbons and water from said well; passing part or all of said wellstream through a cold-flow reactor, said cold-flow reactor having one or more static mixers disposed therein; reducing the droplet size of said water in part or all of said wellstream by passing part or all of said wellstream through said one or more static mixers; converting at least a portion of said water into dry hydrates; feeding said dry hydrates into said wellstream to convert substantially all of the water in said wellstream to dry hydrates, thereby forming a wellstream comprising dry hydrates and hydrocarbons; transporting said wellstream comprising dry hydrates and hydrocarbons through a pipeline; and recovering said hydrocarbons from said pipeline. The cold-flow reactor can be positioned within or form part of the pipeline. Alternatively, the cold-flow reactor is positioned external to the pipeline, in which case the cold-flow reactor receives a sidestream of said wellstream.

Another aspect of the invention is a method of producing hydrocarbons from a reservoir and passing the hydrocarbons or a sidestream thereof through a reactor having one or more static mixers so as to convert the wax in the hydrocarbon stream into particles in the stream rather than depositing the wax in the walls of the pipe through which the stream flows. The stream leaving the reactor contains solidified wax particles since the fluid has passed through the temperature and pressure regime where the wax forms. Thus the wax is not deposited as a coating on the pipe since it forms during a turbulent flow from the static mixers rather than depositing laminarly on the walls of the pipe. The normal wax deposition in laminar flow is attributable to the temperature gradient decline from the center flow to the walls.

While the present invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A method for reducing deposition of solid wax in a cold climate pipeline and rendering a pumpable fluid from a stream of liquid hydrocarbon, which includes wax components, said method comprising the steps of:

conveying said stream through a cold climate pipeline comprising:

a cold-flow reactor comprising:

a cold-flow reactor pipe that has a smaller diameter than the pipeline and is of sufficient length to decrease the temperature of hydrocarbons flowing through the cold-flow reactor pipe, at least one static mixer positioned within the cold-flow reactor pipe, an inlet in fluid communication with the pipeline, an outlet in fluid communication with the pipeline, said outlet being downstream of the inlet wherein said stream passes through said cold-flow reactor before or while the wax solidifies, the stream being mixed by the action of said one or more static mixers, resulting in fine wax solids, and conveying the fluid through a pipe to a processing facility.

2. The method of claim 1 where the reactor has means of removing heat from the stream to lower the fluid temperature below the temperature at which the wax solidifies.

3. A method for rendering a pumpable fluid in a cold climate pipeline from a stream of liquid hydrocarbons comprising: wax components, hydrate forming gases, and water or brine phase, the method comprising the steps of:

conveying said stream through a cold-flow reactor comprising:

a cold-flow reactor pipe that has a smaller diameter than the pipeline and is of sufficient length to decrease the temperature of hydrocarbons flowing through the cold-flow reactor pipe, at least one static mixer positioned within the cold-flow reactor pipe, an inlet in fluid communication with the pipeline, an outlet in fluid communication with the pipeline, said outlet being downstream of the inlet, and passing said stream through said cold-flow reactor before or while the wax solidifies, thereby, generating dry hydrate particles and wax solids in said cold-flow reactor, the wax components and the water phase being mixed by the action of the static mixers, resulting in fine hydrate particles and fine wax solids, and conveying the rendered pumpable fluid through the pipeline to a processing facility.

4. The method of claim 3 wherein the reactor has means of removing heat from the stream to get the fluid temperature below the hydrate formation temperature and the wax solidifying temperature.

5. The method of claim 3 further comprising the step of creating a dry hydrate slurry with at least one static mixer outside of and separate from the cold flow reactor and feeding said dry hydrate slurry to said pipeline.

6. The method of claim 5 wherein said cold-flow reactor is located on a platform.

7. The method of claim 5 wherein said cold-flow reactor is located on shore.

8. The method of claim 5 wherein said cold-flow reactor is located on a vessel.

9. The method of claim 5 wherein said dry hydrate slurry comprises dry hydrates in a liquid hydrocarbon.

10. The method of claim 9 wherein said liquid hydrocarbon is a portion of said wellstream.

11. The method of claim 5 wherein said main pipeline contains at least one second static mixer and said dry hydrate slurry is fed into said main pipeline upstream of said at least one second static mixer.

12. The method of claim 5 further comprising seeding said cold-flow reactor with dry hydrate particles before startup of said reactor.

13. The method of claim 5 wherein said cold-flow reactor is subsea.

14. The method of claim 10 wherein no more than 5% of said wellstream is diverted to said cold-flow reactor to generate said dry hydrate slurry.

15. The method of claim 14 wherein no more than 1% of said wellstream is diverted to said cold-flow reactor to generate said dry hydrate slurry.

16. The method of claim 5 wherein the particle size of dry hydrate in said dry hydrate slurry is about 1 to about 30 microns in diameter.

17. The method of claim 3 wherein said pipe of smaller diameter comprises alternating upward downward flowing portions.

18. The method of claim 17 wherein said alternating downward and upward flowing portions comprise at least two cold-flow reactors connected to each other, each containing at least one static mixer.

19. The method of claim 18 wherein about 10% of said wellstream is introduced to said cold-flow reactor.

20. The method of claim 18 wherein each of said at least two cold-flow reactors has at least one static mixer installed in one of said upward flowing portions of said pipe.

21. The method of claim 5 wherein said dry hydrate slurry is delivered to said main pipeline via an injection umbilical.

22. The method of claim 5 wherein said cold-flow reactor comprises a gas fluid connection to a gas tank and said wellstream contains a gas phase and a liquid phase; further comprising feeding a portion of said wellstream to said cold-flow reactor and separating said gas phase from said liquid phase.

23. The method of claim 5 wherein said cold-flow reactor is a falling film reactor.

24. The method of claim 23 wherein a diverted portion of said wellstream is injected along the walls of said falling film reactor.

25. The method of claim 24 further comprising injecting water and high pressure gas into said falling film reactor to form dry hydrate particles along the walls of said reactor.

26. The method of claim 25 wherein the injected water and high pressure gas are separated from said dry hydrate slurry before feeding into said main pipeline.

27. The method of claim 5 wherein at least a portion of the cold-flow reactor has roughened walls.

28. The method of claim 5 wherein about 1-5% of said wellstream is fed to said at least one static mixer in said cold flow reactor and wherein said 1-5% is thereafter fed along with about 10% more of said wellstream to a second static mixer larger than said at least one static mixer, and the effluent thereof is returned to said wellstream.

29. A method for rendering a pumpable fluid in a cold climate pipeline from a stream of liquid hydrocarbons with wax components, comprising the steps of:

conveying said stream through a cold-flow reactor comprising:

a cold-flow reactor pipe that has a smaller diameter than the pipeline and is of sufficient length to decrease the temperature of hydrocarbons flowing through the cold-flow reactor pipe, at least one static mixer positioned within the cold-flow reactor pipe, an inlet in fluid communication with the pipeline, an outlet in fluid communication with the pipeline, said outlet being downstream of the inlet, and passing said stream through said cold-flow reactor before or while the fluid temperature drops below the wax solidifying temperature, adding dry hydrate particles to the stream before or in said cold-flow reactor, resulting in fine wax solids, and conveying the stream through the pipeline to a processing facility.

30. The method of claim 29 wherein said dry hydrate particles are added to said stream before said reactor and hydrate forming gases and water or brine phase are converted to dry hydrates before said reactor.

31. A method for rendering a pumpable fluid in a cold climate pipeline from a stream of hydrocarbons comprising the steps of:

precipitating or crystallizing components in said stream by the steps of:

conveying said stream through a cold-flow reactor comprising:

a cold-flow reactor pipe that has a smaller diameter than the pipeline and is of sufficient length to decrease the temperature of hydrocarbons flowing through the cold-flow reactor pipe, at least one static mixer positioned within the cold-flow reactor pipe, an inlet in fluid communication with the pipeline, an outlet in fluid communication with the pipeline, said outlet being downstream of the inlet, and a means to reduce the temperature of said stream below the precipitation or crystallization temperature of the components, thereby generating in said stream, finely divided solid particles that do not prevent fluid flow in said pipe, and conveying said fluids through the pipeline to a processing facility.

32. A cold climate pipeline comprising:

a cold-flow reactor comprising:

a cold-flow reactor pipe that is of sufficient length to decrease the temperature of hydrocarbons flowing through the cold-flow reactor pipe, and at least one static mixer positioned within the cold-flow reactor pipe, an inlet, an outlet, wherein said cold-flow reactor is in fluid communication with said pipeline, such that the inlet of the cold-flow reactor and the outlet of the cold flow reactor are in fluid communication with the pipeline and the inlet of the cold-flow reactor is upstream of the outlet of the cold-flow reactor.

33. A method of transporting hydrocarbons using the pipeline of claim 32.

34. The pipeline of claim 32 further comprising means for seeding said cold-flow reactor with dry hydrate particles.

35. The pipeline of claim 32 for transporting a wellstream of hydrocarbons containing water, wherein said pipeline is substantially free of energized equipment.

36. The pipeline of claim 35 further comprising an injection umbilical connected from said cold-flow reactor to a facility above sea level wherein said cold-flow reactor is installed subsea.

37. The pipeline of claim 35 wherein said cold-flow reactor comprises a gas fluid connection to a gas tank.

38. The pipeline of claim 35 wherein said cold-flow reactor comprises a falling film reactor.

39. The pipeline of claim 35 wherein said cold-flow reactor comprises roughened walls in said pipe.

40. A method for producing hydrocarbons from a wellhead using the pipeline of claim 35.

41. The method of claim 40 wherein said hydrocarbons are liquids.

42. The subsea or artic pipeline of claim 32, wherein the cold-flow reactor pipe has a diameter of about 0.5-10 cm.

43. A method of producing hydrocarbons in a cold climate, comprising:

providing a well in a hydrocarbon reservoir;

passing part or all of said wellstream through a cold-flow reactor comprising:

a cold-flow reactor pipe that has a smaller diameter than the pipeline and is of sufficient length to decrease the temperature of hydrocarbons flowing through the cold-flow reactor pipe, at least one static mixer positioned within the cold-flow reactor pipe, an inlet in fluid communication with the pipeline, an outlet in fluid communication with the pipeline, said outlet being downstream of the inlet;

converting substantially all of said water into dry hydrates;

transporting said wellstream comprising dry hydrates and hydrocarbons through a pipeline; and recovering said hydrocarbons from said pipeline.

* * * * *